US007900372B2

(12) United States Patent
Prajescu et al.

(10) Patent No.: US 7,900,372 B2
(45) Date of Patent: Mar. 8, 2011

(54) CLOTHES DRYER WITH LOUVRE COVER

(75) Inventors: Silvia Ionelia Prajescu, Dollard Des Ormeaux (CA); Pasquale Antonio Renzo, Anjou (CA); Dominique Larochelle, St-Bruno (CA)

(73) Assignee: Mabe Canada Inc., Burlington (CA)

( * ) Notice: Subject to any disclaimer, the term of this patent is extended or adjusted under 35 U.S.C. 154(b) by 154 days.

(21) Appl. No.: 12/232,211

(22) Filed: Sep. 12, 2008

(65) Prior Publication Data

US 2009/0260251 A1 Oct. 22, 2009

(30) Foreign Application Priority Data

Apr. 18, 2008 (CA) ..... 2629493

(51) Int. Cl.
*F26B 25/06* (2006.01)

(52) U.S. Cl. ..... 34/235; 34/595; 34/601; 34/602; 34/605; 34/606; 68/139; 68/19; 312/223.2; 362/147; 361/692; 248/56; 211/26

(58) Field of Classification Search ..... 34/235, 34/595, 601, 602, 605, 606; 68/139; 312/223.2; 362/147; 248/56; 361/692; 211/26
See application file for complete search history.

(56) References Cited

U.S. PATENT DOCUMENTS

| | | | | | |
|---|---|---|---|---|---|
| RE16,707 | E | * | 8/1927 | Kahn | 126/67 |
| 1,966,011 | A | * | 7/1934 | Hubbell | 165/69 |
| 2,008,945 | A | * | 7/1935 | Child | 237/78 R |
| 2,027,192 | A | * | 1/1936 | Muffly | 62/161 |
| 2,062,413 | A | * | 12/1936 | Grady | 261/92 |
| 2,067,504 | A | * | 1/1937 | Richard | 62/450 |
| 2,078,343 | A | * | 4/1937 | Replogle | 62/335 |
| 2,157,307 | A | * | 5/1939 | Savage | 96/379 |
| 2,160,269 | A | * | 5/1939 | Jorolemon | 126/113 |
| 2,203,497 | A | * | 6/1940 | Kitto et al. | 62/148 |
| 2,234,771 | A | * | 3/1941 | Moore | 62/262 |
| 2,284,138 | A | * | 5/1942 | Evans et al. | 126/93 |
| 2,353,202 | A | * | 7/1944 | Tautz | 144/135.2 |
| 2,362,698 | A | * | 11/1944 | Hull | 62/262 |
| 2,422,805 | A | * | 6/1947 | Scott, Jr. | 361/116 |
| 2,429,881 | A | * | 10/1947 | Hoover | 62/429 |
| 2,516,184 | A | * | 7/1950 | Christie | 361/695 |
| 2,517,421 | A | * | 8/1950 | Geldhof | 432/117 |
| 2,529,203 | A | * | 11/1950 | Turpin | 62/295 |
| 2,581,942 | A | * | 1/1952 | Collins et al. | 126/110 R |
| 2,583,850 | A | * | 1/1952 | Kauffman | 34/82 |
| 2,600,316 | A | * | 6/1952 | Moore | 62/427 |
| 2,606,429 | A | * | 8/1952 | Atchison | 62/456 |
| 2,637,532 | A | * | 5/1953 | Baker | 237/2 R |
| 2,656,780 | A | * | 10/1953 | Spieth | 454/321 |
| 2,682,159 | A | * | 6/1954 | Trask | 62/262 |

(Continued)

FOREIGN PATENT DOCUMENTS

DE 4300577 A1 * 7/1993

(Continued)

*Primary Examiner* — Stephen M. Gravini

(57) ABSTRACT

A clothes dryer has horizontally extending louvres located in its rear cabinet wall that permit ambient air to enter the dryer cabinet during normal dryer operation. U-shaped cover brackets are positioned to horizontally extend and cover the louvres where the brackets each define a horizontally extending airflow channel having opposing open ends. Air entering the dryer flows through the louvres along the airflow channels and out through the open ends. The cover bracket helps to contain a fire within the dryer cabinet should one occur by restricting flow of ignited particles and other debris as a result of a fire from exiting through the louvre.

10 Claims, 6 Drawing Sheets

U.S. PATENT DOCUMENTS

| | | | | | |
|---|---|---|---|---|---|
| 2,758,456 | A | * | 8/1956 | Wheeler | 62/262 |
| 2,783,620 | A | * | 3/1957 | Herndon, Jr. | 62/156 |
| 2,808,823 | A | * | 10/1957 | Snyder et al. | 126/93 |
| 2,830,385 | A | * | 4/1958 | Smith | 34/601 |
| 2,886,124 | A | * | 5/1959 | Scharmer | 96/121 |
| 2,907,262 | A | * | 10/1959 | Sweedyk et al. | 454/319 |
| 2,912,834 | A | * | 11/1959 | Mann | 62/276 |
| 2,925,664 | A | * | 2/1960 | Cobb et al. | 34/79 |
| 2,934,324 | A | * | 4/1960 | Partington | 165/296 |
| 2,945,362 | A | * | 7/1960 | Gould et al. | 62/429 |
| 2,962,875 | A | * | 12/1960 | Barroero | 62/256 |
| 2,965,819 | A | * | 12/1960 | Rosenbaum | 257/722 |
| 2,971,451 | A | * | 2/1961 | Feig | 126/299 D |
| 3,000,108 | A | * | 9/1961 | Jones et al. | 34/607 |
| 3,025,683 | A | * | 3/1962 | Baker et al. | 62/419 |
| 3,032,887 | A | * | 5/1962 | Whyte et al. | 34/524 |
| 3,060,591 | A | * | 10/1962 | Liebermann | 34/572 |
| 3,063,357 | A | * | 11/1962 | Eberhart | 454/320 |
| 3,120,606 | A | * | 2/1964 | Eckert, Jr. et al. | 708/490 |
| 3,125,089 | A | * | 3/1964 | Taylor | 126/110 B |
| 3,157,176 | A | * | 11/1964 | Pearce et al. | 126/37 R |
| 3,192,306 | A | * | 6/1965 | Skonnord | 174/16.1 |
| 3,235,325 | A | * | 2/1966 | Storchheim | 96/224 |
| 3,238,702 | A | * | 3/1966 | De Seversky | 96/45 |
| 3,263,749 | A | * | 8/1966 | Dormitzer | 165/122 |
| 3,265,862 | A | * | 8/1966 | Smith, Jr. et al. | 219/405 |
| 3,308,609 | A | * | 3/1967 | McCulloch et al. | 55/319 |
| 3,321,196 | A | * | 5/1967 | Weatherston et al. | 261/130 |
| 3,324,782 | A | * | 6/1967 | Norris et al. | 454/236 |
| 3,379,241 | A | * | 4/1968 | Gau | 165/53 |
| 3,402,281 | A | * | 9/1968 | Vonderhaar | 219/408 |
| 3,403,533 | A | * | 10/1968 | Bollenbacher | 62/408 |
| 3,444,805 | A | * | 5/1969 | Mitter et al. | 99/340 |
| 3,507,265 | A | * | 4/1970 | Dills et al. | 126/21 R |
| 3,676,000 | A | * | 7/1972 | Mayer, Jr. et al. | 355/52 |
| 3,680,469 | A | * | 8/1972 | Vandermey | 454/323 |
| 3,704,925 | A | * | 12/1972 | Scott | 312/228 |
| 3,720,196 | A | * | 3/1973 | Barnett et al. | 126/197 |
| 3,750,418 | A | * | 8/1973 | Maudlin | 62/290 |
| 3,781,109 | A | * | 12/1973 | Mayer et al. | 355/52 |
| 3,859,499 | A | * | 1/1975 | Evans et al. | 219/396 |
| 3,897,721 | A | * | 8/1975 | Fuhst | 454/59 |
| 3,903,404 | A | * | 9/1975 | Beall et al. | 361/679.4 |
| 3,928,008 | A | * | 12/1975 | Petersen | 55/472 |
| 3,984,180 | A | * | 10/1976 | Hadzimahalis | 352/146 |
| 3,991,484 | A | * | 11/1976 | Lamb et al. | 34/659 |
| 4,015,579 | A | * | 4/1977 | Wirth et al. | 126/502 |
| 4,047,515 | A | * | 9/1977 | Daniel | 126/110 R |
| 4,086,707 | A | * | 5/1978 | Bochan | 34/554 |
| 4,111,001 | A | * | 9/1978 | Loos | 62/427 |
| 4,155,348 | A | * | 5/1979 | Ahlrich | 126/299 D |
| 4,180,052 | A | * | 12/1979 | Henderson | 126/517 |
| 4,180,919 | A | * | 1/1980 | Baltes | 34/449 |
| 4,208,884 | A | * | 6/1980 | Popham | 62/282 |
| 4,266,528 | A | * | 5/1981 | Barnhart et al. | 126/299 D |
| 4,295,233 | A | * | 10/1981 | Hinkel et al. | 4/619 |
| 4,309,594 | A | * | 1/1982 | Jones | 392/356 |
| 4,338,792 | A | * | 7/1982 | Ibrahim | 62/256 |
| 4,361,525 | A | * | 11/1982 | Leyland | 261/152 |
| 4,369,631 | A | * | 1/1983 | Abraham | 62/82 |
| 4,389,856 | A | * | 6/1983 | Ibrahim | 62/248 |
| 4,400,185 | A | * | 8/1983 | Goettl | 96/359 |
| 4,418,511 | A | * | 12/1983 | Collin | 53/427 |
| 4,449,374 | A | * | 5/1984 | Ibrahim | 62/81 |
| 4,579,570 | A | * | 4/1986 | Klaas | 55/305 |
| 4,663,536 | A | * | 5/1987 | Roesel et al. | 290/7 |
| 4,681,609 | A | * | 7/1987 | Howeth | 55/302 |
| 4,690,100 | A | * | 9/1987 | Thomas | 119/419 |
| 4,704,144 | A | * | 11/1987 | LeBlanc et al. | 55/300 |
| 4,723,419 | A | * | 2/1988 | Kessler et al. | 62/507 |
| 4,893,478 | A | * | 1/1990 | Kruck et al. | 62/126 |
| 4,907,419 | A | * | 3/1990 | Kruck et al. | 62/263 |
| 4,977,756 | A | * | 12/1990 | Brock | 62/314 |
| 5,000,157 | A | * | 3/1991 | Harper et al. | 126/41 R |
| 5,007,246 | A | * | 4/1991 | Kruck et al. | 62/131 |
| 5,009,081 | A | * | 4/1991 | Kruck et al. | 62/264 |
| 5,015,420 | A | * | 5/1991 | Jones | 261/29 |
| 5,127,169 | A | * | 7/1992 | Ellingson | 34/601 |
| 5,168,621 | A | * | 12/1992 | Kruck et al. | 29/451 |
| 5,249,121 | A | * | 9/1993 | Baum et al. | 606/1 |
| 5,265,656 | A | * | 11/1993 | McGarvey | 141/198 |
| 5,290,188 | A | * | 3/1994 | Kiser et al. | 454/234 |
| 5,368,008 | A | * | 11/1994 | Oslin | 126/20.2 |
| 5,374,118 | A | * | 12/1994 | Kruck et al. | 312/407 |
| 5,417,246 | A | * | 5/1995 | Perkins et al. | 137/870 |
| 5,513,071 | A | * | 4/1996 | LaViolette et al. | 361/703 |
| 5,549,139 | A | * | 8/1996 | Perkins et al. | 137/884 |
| 5,640,946 | A | * | 6/1997 | Oslin | 126/20 |
| 5,674,039 | A | * | 10/1997 | Walker et al. | 414/222.05 |
| 5,697,840 | A | * | 12/1997 | Bainbridge et al. | 454/184 |
| 5,732,614 | A | * | 3/1998 | Oslin | 99/341 |
| 5,755,040 | A | * | 5/1998 | Ou | 34/202 |
| 5,837,207 | A | * | 11/1998 | Summers | 422/121 |
| 5,857,485 | A | * | 1/1999 | Perkins et al. | 137/487.5 |
| 5,964,065 | A | * | 10/1999 | Migurski et al. | 52/64 |
| 5,979,494 | A | * | 11/1999 | Perkins et al. | 137/487.5 |
| 5,983,543 | A | * | 11/1999 | Hillstrom | 40/574 |
| 5,992,410 | A | * | 11/1999 | Raleigh et al. | 126/110 AA |
| 6,009,748 | A | * | 1/2000 | Hildebrandt et al. | 73/60.11 |
| 6,099,607 | A | * | 8/2000 | Haslebacher | 55/356 |
| 6,119,767 | A | * | 9/2000 | Kadota et al. | 165/104.33 |
| 6,125,565 | A | * | 10/2000 | Hillstrom | 40/574 |
| 6,179,434 | B1 | * | 1/2001 | Saraiji | 362/125 |
| 6,223,553 | B1 | * | 5/2001 | Albert et al. | 62/407 |
| 6,298,589 | B1 | * | 10/2001 | Hillstrom | 40/574 |
| 6,351,964 | B1 | * | 3/2002 | Brancheau et al. | 62/249 |
| 6,491,514 | B1 | * | 12/2002 | Hamad et al. | 431/114 |
| 6,543,250 | B1 | * | 4/2003 | Mills et al. | 62/428 |
| 6,558,017 | B1 | * | 5/2003 | Saraiji et al. | 362/125 |
| 6,575,046 | B1 | * | 6/2003 | Redington | 73/861.74 |
| 6,575,230 | B1 | * | 6/2003 | Kadota et al. | 165/104.33 |
| 6,590,768 | B1 | * | 7/2003 | Wiley | 361/690 |
| 6,631,576 | B2 | * | 10/2003 | Hillstrom | 40/574 |
| 6,675,588 | B2 | * | 1/2004 | Rudick | 62/6 |
| 6,698,228 | B2 | * | 3/2004 | Kateman et al. | 62/346 |
| 6,843,011 | B2 | * | 1/2005 | Hillstrom | 40/574 |
| 6,851,226 | B2 | * | 2/2005 | MacGregor et al. | 52/36.1 |
| 6,888,474 | B2 | * | 5/2005 | Sharp et al. | 340/907 |
| 6,909,603 | B2 | * | 6/2005 | Wiley | 361/690 |
| 6,911,186 | B2 | * | 6/2005 | Taylor et al. | 422/186.07 |
| 6,932,443 | B1 | * | 8/2005 | Kaplan et al. | 312/213 |
| 6,952,928 | B2 | * | 10/2005 | Kateman et al. | 62/71 |
| 6,974,560 | B2 | * | 12/2005 | Taylor et al. | 422/186.04 |
| 6,984,987 | B2 | * | 1/2006 | Taylor et al. | 324/509 |
| 7,021,078 | B2 | * | 4/2006 | Kucera | 62/310 |
| 7,051,539 | B2 | * | 5/2006 | Junge et al. | 62/90 |
| 7,052,728 | B2 | * | 5/2006 | Kateman et al. | 426/515 |
| 7,100,906 | B2 | * | 9/2006 | Kucera | 261/97 |
| 7,114,346 | B2 | * | 10/2006 | Kucera et al. | 62/314 |
| 7,131,279 | B2 | * | 11/2006 | Kateman et al. | 62/71 |
| 7,174,663 | B2 | * | 2/2007 | Hillstrom | 40/574 |
| 7,237,401 | B2 | * | 7/2007 | Kucera et al. | 62/314 |
| 7,308,798 | B2 | * | 12/2007 | Caggiano | 62/63 |
| 7,318,856 | B2 | * | 1/2008 | Taylor et al. | 96/16 |
| 7,342,789 | B2 | * | 3/2008 | Hall et al. | 361/701 |
| 7,371,354 | B2 | * | 5/2008 | Lau | 422/186.04 |
| 7,425,678 | B2 | * | 9/2008 | Adducci et al. | 174/50 |
| 7,427,713 | B2 | * | 9/2008 | Adducci et al. | 174/50 |
| 7,476,804 | B2 | * | 1/2009 | Adducci et al. | 174/50 |
| 7,485,803 | B2 | * | 2/2009 | Adducci et al. | 174/50 |
| 7,486,513 | B2 | * | 2/2009 | Hall et al. | 361/699 |
| 7,495,169 | B2 | * | 2/2009 | Adducci et al. | 174/50 |
| 7,498,512 | B2 | * | 3/2009 | Adducci et al. | 174/50 |
| 7,504,581 | B2 | * | 3/2009 | Adducci et al. | 174/50 |
| 7,531,141 | B2 | * | 5/2009 | Descotes et al. | 422/121 |
| 7,592,541 | B2 | * | 9/2009 | Adducci et al. | 174/50 |
| 7,595,985 | B2 | * | 9/2009 | Adducci et al. | 361/695 |
| 7,608,779 | B2 | * | 10/2009 | Adducci et al. | 174/50 |
| 7,667,135 | B2 | * | 2/2010 | Adducci et al. | 174/50 |
| 7,687,748 | B2 | * | 3/2010 | Gagas | 219/623 |
| 7,707,920 | B2 | * | 5/2010 | Gass et al. | 83/781 |
| 7,718,891 | B2 | * | 5/2010 | Adducci et al. | 174/50 |
| 7,772,489 | B2 | * | 8/2010 | Adducci et al. | 174/50 |
| 7,781,675 | B2 | * | 8/2010 | Adducci et al. | 174/50 |
| 7,795,532 | B2 | * | 9/2010 | Walker | 174/50 |
| 2001/0011459 | A1 | * | 8/2001 | Rudick | 62/6 |
| 2001/0032404 | A1 | * | 10/2001 | Hillstrom | 40/574 |

2003/0026415 A1* 2/2003 Laetsch ..... 379/338
2003/0078015 A1* 4/2003 Laetsch ..... 455/90
2003/0085237 A1* 5/2003 Kateman et al. ..... 222/1
2003/0154673 A1* 8/2003 MacGregor et al. ..... 52/239
2003/0206837 A1* 11/2003 Taylor et al. ..... 422/186
2003/0206839 A1* 11/2003 Taylor et al. ..... 422/186.04
2003/0206840 A1* 11/2003 Taylor et al. ..... 422/186.04
2003/0209420 A1* 11/2003 Taylor et al. ..... 204/164
2004/0045200 A1* 3/2004 Hillstrom ..... 40/574
2004/0070520 A1* 4/2004 Sharp et al. ..... 340/909
2004/0072534 A1* 4/2004 Wiley ..... 454/184
2004/0112078 A1* 6/2004 Kateman et al. ..... 62/342
2004/0144128 A1* 7/2004 Junge et al. ..... 62/441
2004/0187401 A1* 9/2004 Krestakos et al. ..... 52/79.1
2004/0250554 A1* 12/2004 Kateman et al. ..... 62/71
2004/0251124 A1* 12/2004 Lau ..... 204/164
2004/0251909 A1* 12/2004 Taylor et al. ..... 324/509
2005/0000240 A1* 1/2005 Kucera ..... 62/310
2005/0000241 A1* 1/2005 Kucera et al. ..... 62/314
2005/0000242 A1* 1/2005 Kucera et al. ..... 62/314
2005/0005529 A1* 1/2005 Brault et al. ..... 52/63
2005/0029371 A1* 2/2005 Kucera ..... 239/590
2005/0086871 A1* 4/2005 MacGregor et al. ..... 52/36.1
2005/0099319 A1* 5/2005 Hutchison et al. ..... 340/908
2005/0139057 A1* 6/2005 Gass et al. ..... 83/477.2
2005/0158219 A1* 7/2005 Taylor et al. ..... 422/121
2005/0163669 A1* 7/2005 Taylor et al. ..... 422/121
2005/0166736 A1* 8/2005 Gass et al. ..... 83/477.2
2005/0183576 A1* 8/2005 Taylor et al. ..... 96/16
2005/0198990 A1* 9/2005 Kateman et al. ..... 62/342
2005/0204918 A1* 9/2005 Brown ..... 95/273
2005/0229453 A1* 10/2005 Hillstrom ..... 40/574
2006/0041448 A1* 2/2006 Patterson et al. ..... 705/1
2006/0162347 A1* 7/2006 Kateman et al. ..... 62/71
2006/0162348 A1* 7/2006 Kateman et al. ..... 62/71
2006/0278215 A1* 12/2006 Gagas et al. ..... 126/299 D
2007/0002536 A1* 1/2007 Hall et al. ..... 361/695
2007/0023420 A1* 2/2007 Gagas ..... 219/623
2007/0056307 A1* 3/2007 Caggiano ..... 62/271
2007/0062513 A1* 3/2007 Gagas ..... 126/299 D
2007/0151433 A1* 7/2007 Gass et al. ..... 83/477.2
2007/0157784 A1* 7/2007 Gass et al. ..... 83/581
2007/0163170 A1* 7/2007 Brault et al. ..... 47/17
2007/0175306 A1* 8/2007 Gass et al. ..... 83/477.2
2007/0210679 A1* 9/2007 Adducci et al. ..... 312/7.2
2007/0210680 A1* 9/2007 Appino et al. ..... 312/7.2
2007/0210681 A1* 9/2007 Adducci et al. ..... 312/7.2
2007/0210683 A1* 9/2007 Adducci et al. ..... 312/223.1
2007/0210686 A1* 9/2007 Adducci et al. ..... 312/265.2
2007/0221393 A1* 9/2007 Adducci et al. ..... 174/50
2007/0293138 A1* 12/2007 Adducci et al. ..... 454/184
2008/0010923 A1* 1/2008 MacGregor et al. ..... 52/239
2008/0029081 A1* 2/2008 Gagas et al. ..... 126/299 D
2008/0036339 A1* 2/2008 Adducci et al. ..... 312/223.2
2008/0036340 A1* 2/2008 Adducci et al. ..... 312/223.2
2008/0055851 A1* 3/2008 Hall et al. ..... 361/695
2008/0055856 A1* 3/2008 Hall et al. ..... 361/701
2008/0067903 A1* 3/2008 Adducci et al. ..... 312/223.1
2008/0067904 A1* 3/2008 Adducci et al. ..... 312/223.1
2008/0074012 A1* 3/2008 Adducci et al. ..... 312/7.2
2008/0074849 A1* 3/2008 Adducci et al. ..... 361/724
2008/0079340 A1* 4/2008 Adducci et al. ..... 312/286
2008/0086994 A1* 4/2008 Descotes et al. ..... 55/471
2008/0173631 A1* 7/2008 Gagas et al. ..... 219/400
2008/0174217 A1* 7/2008 Walker ..... 312/329
2008/0178722 A1* 7/2008 Gass et al. ..... 83/478
2008/0184720 A1* 8/2008 Morgan et al. ..... 62/150
2008/0184984 A1* 8/2008 Elkasevic ..... 126/198
2008/0185372 A1* 8/2008 Elkasevic ..... 219/391
2008/0185942 A1* 8/2008 Elkasevic et al. ..... 312/236
2008/0212282 A1* 9/2008 Hall et al. ..... 361/701
2008/0290052 A1* 11/2008 Wagner et al. ..... 211/26
2009/0044703 A1* 2/2009 Bias et al. ..... 96/66
2009/0086429 A1* 4/2009 Grosskreuz et al. ..... 361/695
2009/0122484 A1* 5/2009 Caveney ..... 361/692
2009/0134750 A1* 5/2009 Adducci et al. ..... 312/223.2
2009/0135559 A1* 5/2009 Adducci et al. ..... 361/692
2009/0257219 A1* 10/2009 Doubek ..... 362/147
2009/0260249 A1* 10/2009 Renzo ..... 34/201
2009/0260251 A1* 10/2009 Prajescu et al. ..... 34/235
2009/0277210 A1* 11/2009 Eveland et al. ..... 62/441
2010/0041327 A1* 2/2010 Desler ..... 454/184
2010/0050843 A1* 3/2010 Gass et al. ..... 83/477.1
2010/0163549 A1* 7/2010 Gagas et al. ..... 219/622
2010/0192404 A1* 8/2010 Maltese et al. ..... 34/524
2010/0192405 A1* 8/2010 Rosca ..... 34/572
2010/0208433 A1* 8/2010 Heimann et al. ..... 361/724
2010/0219726 A1* 9/2010 Nicewicz et al. ..... 312/223.2

FOREIGN PATENT DOCUMENTS

DE 10337322 A1 * 4/2004
DE 10337323 A1 * 6/2004
EP 372718 A1 * 6/1990
JP 56024228 A * 3/1981
JP 57020593 A * 2/1982
JP 58208524 A * 12/1983
JP 59048270 A * 3/1984
JP 60014020 A * 1/1985
JP 61008534 A * 1/1986
JP 61084663 A * 4/1986
JP 62062144 A * 3/1987
JP 02131109 A * 5/1990
JP 03191938 A * 8/1991
JP 04024463 A * 1/1992
JP 04103961 A * 4/1992
JP 04273937 A * 9/1992
JP 06017703 A * 1/1994
JP 06092226 A * 4/1994
JP 08028945 A * 2/1996
JP 08130817 A * 5/1996
JP 08225021 A * 9/1996
JP 10133550 A * 5/1998
JP 11138103 A * 5/1999
JP 11138104 A * 5/1999
JP 11314069 A * 11/1999
JP 2000296721 A * 10/2000
JP 2001164944 A * 6/2001
JP 2001215028 A * 8/2001
JP 2002284094 A * 10/2002
JP 2003160074 A * 6/2003
JP 2004119844 A * 4/2004
JP 2006064896 A * 3/2006
JP 2006266574 A * 10/2006
JP 2007315744 A * 12/2007
JP 2008219109 A * 9/2008
JP 2008250009 A * 10/2008
JP 2010097036 A * 4/2010
WO WO 2004018244 A1 * 3/2004
WO WO 2005060366 A2 * 7/2005
* cited by examiner

CLOTHES DRYER WITH LOUVRE COVER

FIELD OF THE INVENTION

The present invention relates to a clothes dryer and, more particularly, relates to one or more covers placed over air entry louvres to restrict the flow of ignited particles, and other debris as a result of a fire, from escaping from the dyer through the louvres should a fire develop in the dryer cabinet.

BACKGROUND OF THE INVENTION

In a clothes dryer air is typically circulated across clothing contained in a rotating dryer drum. The air is heated prior to entry into the drum by means of electrically energized heating elements or by a gas burner contained in a heating assembly. Air is either drawn, or blown, through the drum by a fan that moves the air out of the drum across a lint filter and through exhaust venting out of the dryer. Typically, the rear wall of the dryer is provided with louvres comprising horizontal extending openings having fixed sloping fins that allow ambient air to enter the dryer cabinet and pass through the heater assembly. The ambient air is drawn through the louvres into the cabinet due to the negative pressure created in the dryer cabinet by the air moving out of the cabinet via the exhaust venting.

When the dryer is subjected to recent and more stringent fire testing, sparks of ignited particles of cheese cloth, representing dust or lint, rise and fall within the dryer cabinet and in some instances escape from the dryer cabinet through the louvre. Accordingly, there is a need to develop an air flow entry for a dryer that permits ambient air to flow into the dryer during normal dryer operation and restricts the flow of ignited particles and other debris escaping from the dryer cabinet so as to help contain a fire in the cabinet should one develop.

BRIEF DESCRIPTION OF THE INVENTION

The present invention relates to a clothes dryer and, more particularly, relates to one or more covers placed over air entry louvres to restrict the flow of ignited particles and other debris from escaping from the dyer through the louvres should a fire develop in the dryer cabinet.

In accordance with one embodiment of the present invention, a clothes dryer comprises a cabinet having a wall and a louvre located in the wall to allow ambient air to enter the cabinet. The clothes dryer comprises a cover mounted inside the cabinet and mounted to the wall. The cover extends over the louvre to define an air flow channel that permits air to flow into the cabinet through the louvre and along the air flow channel while restricting flow of ignited particles and debris from exiting through the louvre.

In accordance with another embodiment, the cover overlays the louvre and is spaced therefrom. The cover extends along the louvre to define an air flow channel between the cover and the wall where the airflow channel has an at least one opening between the wall and an end portion of the cover to permit air to flow into the cabinet through the louvre, along the air flow channel and out the at least one opening while restricting flow of ignited particles and debris from exiting through the louvre.

By having the cover spaced from the louvre, an airflow channel is defined between the cover and rear wall that extends along the length of the louvre. While this airflow channel forms a restriction to air flowing into the dryer cabinet, this restriction is inconsequential due to the negative pressure induced in the dryer during dryer operation by the blower fan. The blower fan draws ambient air in through the louvre and along the airflow channel into the dryer cabinet space while at the same time pushing heated air from the dryer drum out the dryer exhaust vent. The advantage associated with the use of the cover is that it helps to contain a fire within the dryer should one occur. Any particles which are ignited in the dryer, or other debris as a result of a fire, have a tendency to rise and fall within the dryer cabinet. The cover extending over the louvres restrict flow of rising and falling particles from exiting directly out of the louvre without having to first enter into the airflow channel.

It should be understood that one or more covers preferably extends at least along the entire length of the louvre to form the air flow channel along the length of the louvre and perhaps beyond. This air flow channel is open at the ends of the cover to permit air flow into the dryer.

In an embodiment of the present invention a plurality of louvres are located in a rear wall of the cabinet. Each louvre has a cover that defines an airflow channel extending along the corresponding louvre.

In one embodiment the cover may comprise a bracket that has side walls that extend from the wall of the cabinet to form the airflow channel. In a preferred embodiment the cover has an additional end wall so that it has a u-shaped configuration where the end wall extends between the side walls of the bracket. The side walls further each comprise a flange that lies flush with and may be mounted to the wall of the cabinet. The cover bracket has opposing open ends through which air entering through the louvre moves along the air flow channel and passes through the open ends into the cabinet. It should be understood that while the preferred embodiment is directed to a bracket having a square u-shaped cross-sectional configuration, alternative suitable shapes may be employed such as, for example, a triangular V-shaped cross-sectional shape, a rounded u-shaped cross-sectional shape, or a semi-circular cross-sectional shape. Each of these embodiments provides the airflow channel that extends along the length of the louvre.

BRIEF DESCRIPTION OF THE DRAWINGS

For a more thorough understanding of the nature and objects of the present invention reference may be had, by way of example, to the accompanying diagrammatic drawings in which.

DETAILED DESCRIPTION OF THE INVENTION

Figure 1:
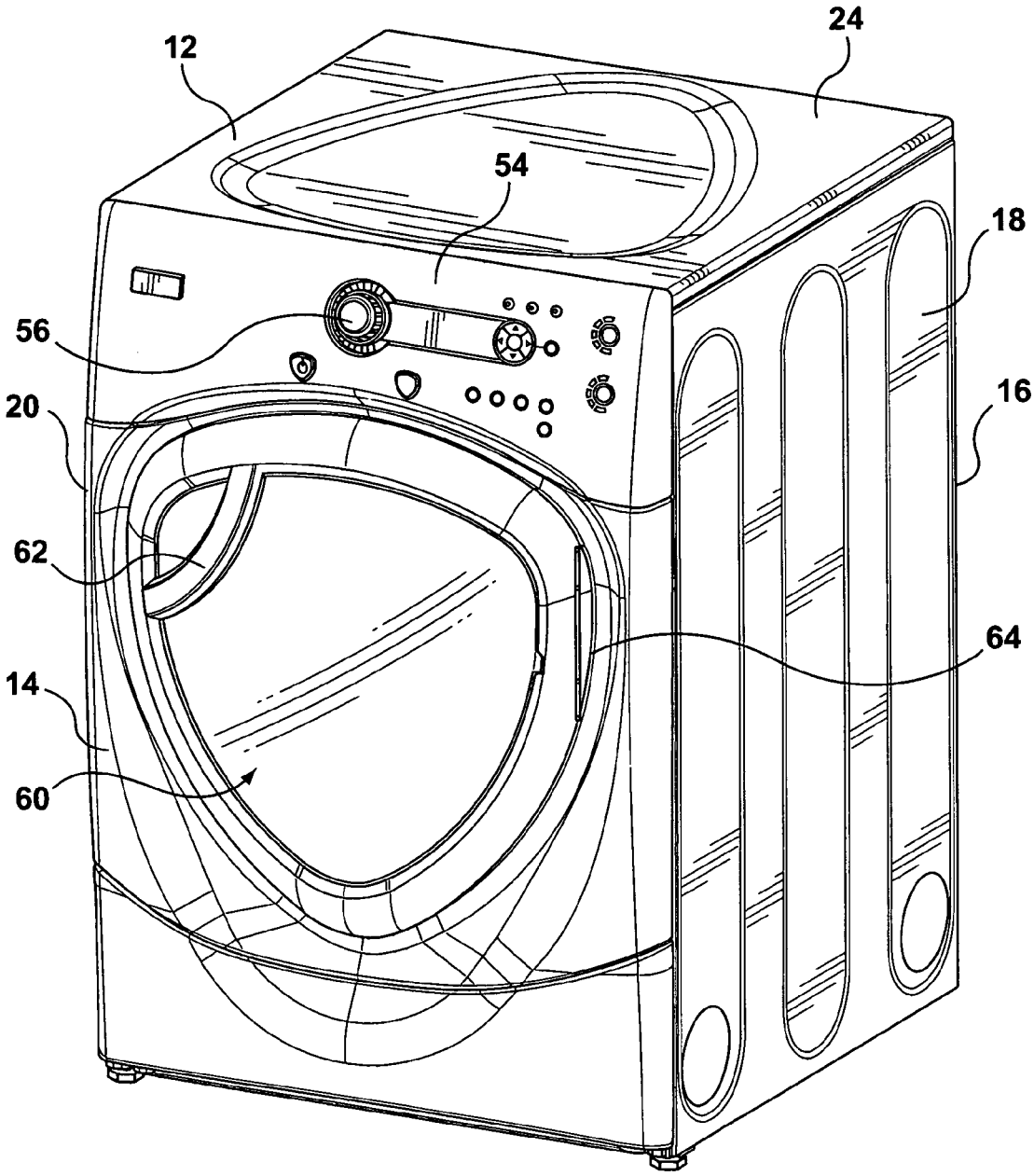
FIG. 1 is a perspective view of an exemplary clothes dryer that may benefit from the present invention.
Figure 2:
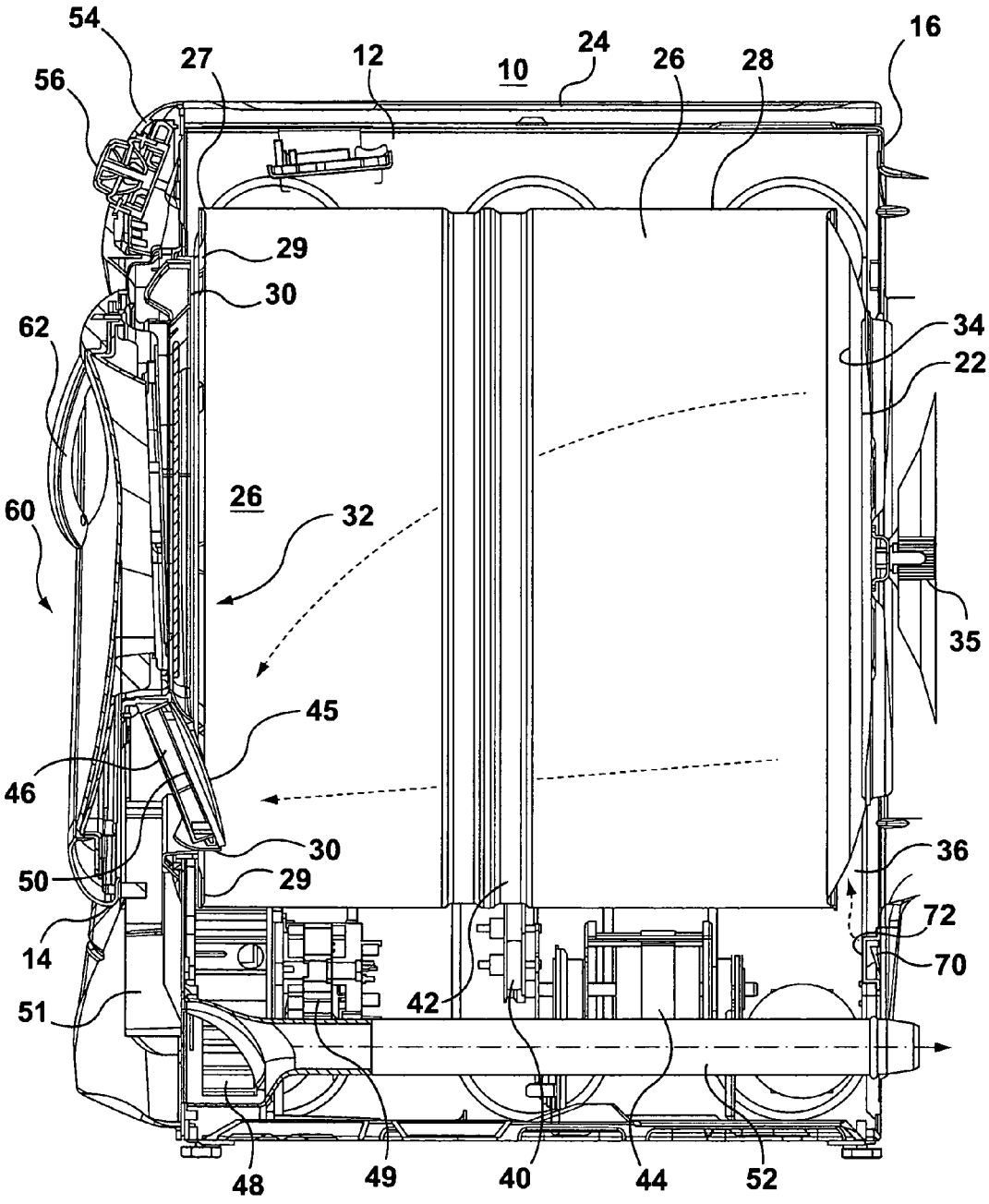
FIG. 2 is a side sectional view of an exemplary clothes dryer that may benefit from the present invention.

FIGS. 1 and 2 show perspective and side sectional views of an exemplary clothes dryer 10 that may benefit from the present invention. The clothes dryer 10 includes a cabinet or a main housing 12 having a front wall 14, a rear wall 16, a pair of side walls 18 and 20 spaced apart from each other by the front and rear walls, and a top cover 24. Within the housing 12 is a drum or container 26 mounted for rotation around a substantially horizontal axis. A motor 44 rotates the drum 26 about the horizontal axis through, for example, a pulley 40 and a belt 42. The drum 26 is generally cylindrical in shape, has an outer cylindrical wall 28, and has an open end 27 that typically comprises a metal ring 29 attached by welding to the drum 26 for reducing the diameter of the opening of the drum 26 to match a front bulkhead wall or front bearing 30. The bearing 30 further defines an opening 32 into the drum 26. Clothing articles and other fabrics are loaded into the drum 26 through the opening 32. A plurality of tumbling ribs (not shown) are provided within the drum 26 to lift the articles and then allow them to tumble back to the bottom of the drum as the drum rotates. The drum 26 includes a rear wall 34 rotatably supported within the main housing 12 by bearing 35. The rear wall 34 includes a plurality of holes (not shown) that receive hot air that has been heated by a heater such as electrical heating elements (not shown) in the heater housing 22. The heater housing 22 receives ambient air via an inlet 36. Although the exemplary clothes dryer 10 shown in FIG. 1 is an electric dryer, it could just as well be a gas dryer having a gas burner.

Heated air is drawn from the drum 26 by a blower fan 48 which is also driven by a second motor 49 in the embodiment shown. In an alternative embodiment, motor 44 could be used to drive blower fan 48. The air passes through a grill 45 and screen filter 46. Grill 45 keeps clothing articles tumbling in the drum 26 from contacting the filter 46 and touching the lint trapped by the filter 46 within the trap duct 50. As the air passes through the screen filter 46, it flows through lower duct portion 51 and is drawn by blower fan 48 attached to motor 49 out of the clothes dryer through an exhaust duct 52. In this embodiment, the drum 26 is in air flow communication with the trap duct 50 whose lower duct portion 51 has an outlet that is in air flow communication with the blower fan 48 and the exhaust duct 52. The exhaust duct 52 passes through the rear wall 16 and is usually connected to suitable venting (not shown) that provides an exhaust path for the dryer heated air to leave the room where the dryer 10 is located.

It should be understood that the blower fan 48 creates a negative type pressure within the dryer cabinet by its operation during normal dryer use. By negative pressure it is meant that because the blower fan 48 is forcing air out of the exhaust duct 52 it is creating a negative pressure in the dryer cabinet which draws air from the ambient outside of the dryer into the dryer cabinet for circulation through the dryer drum 26. In order to have ambient air enter the cabinet 12 the dryer, as shown in FIG. 2, dryer 10 is provided with one or more louvres 70 and covers 72 which will be described in more detail hereinafter.

After the clothing articles have been dried, they may be removed from the drum 26 via the opening 32. Opening 32 is shown closed by a window or port-hole like door 60. Door 60 has a handle 62 for pivotally opening the door about hinge 64.

The dryer 10 is shown to have a control wall 54 with touch and or dial controls 56 that permit the user to control operation of dryer 10.

Figure 3:
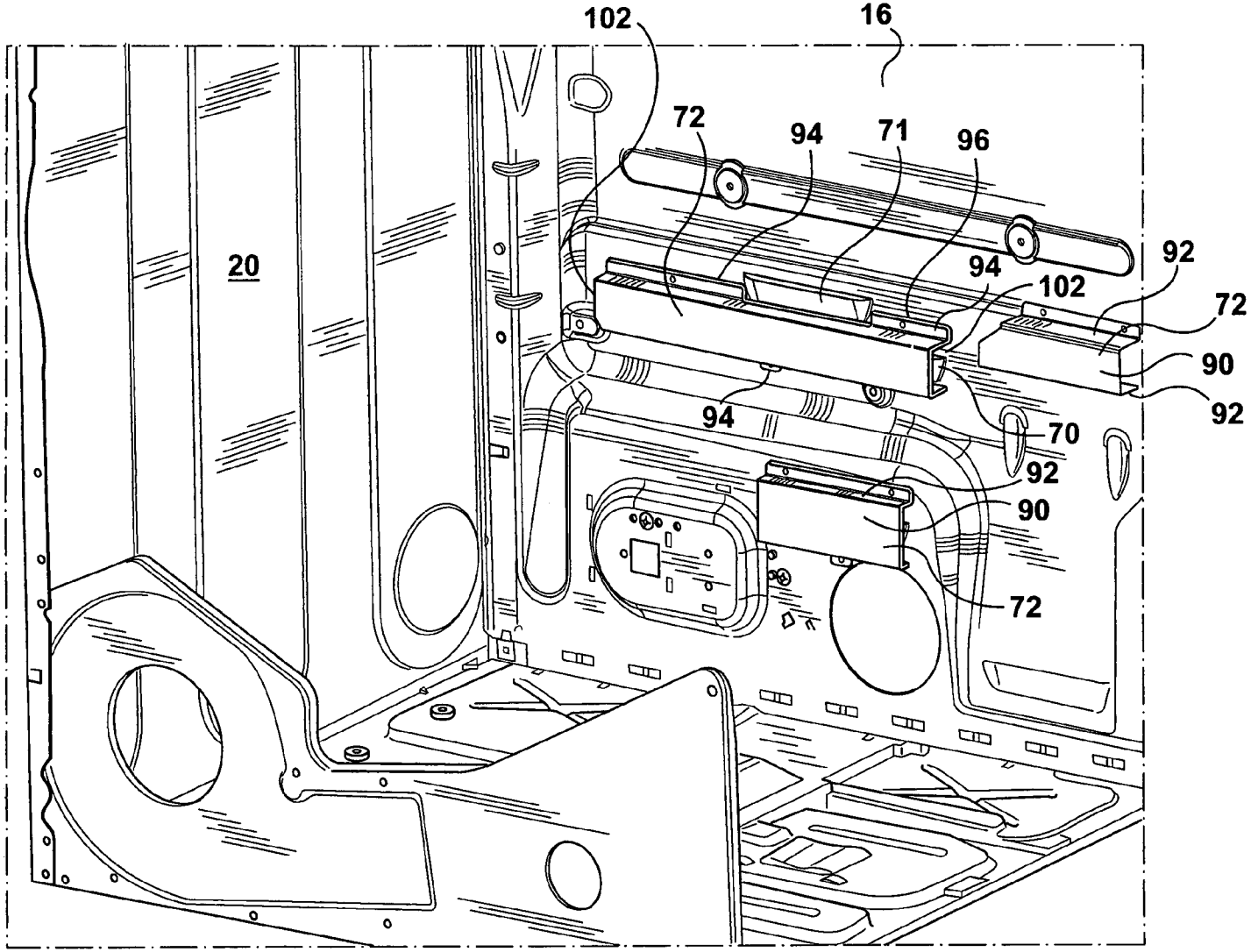
FIG. 3 is an interior perspective of the exemplary clothes dryer showing the rear wall of the clothes dryer cabinet with most of the internal components removed.
Figure 4:
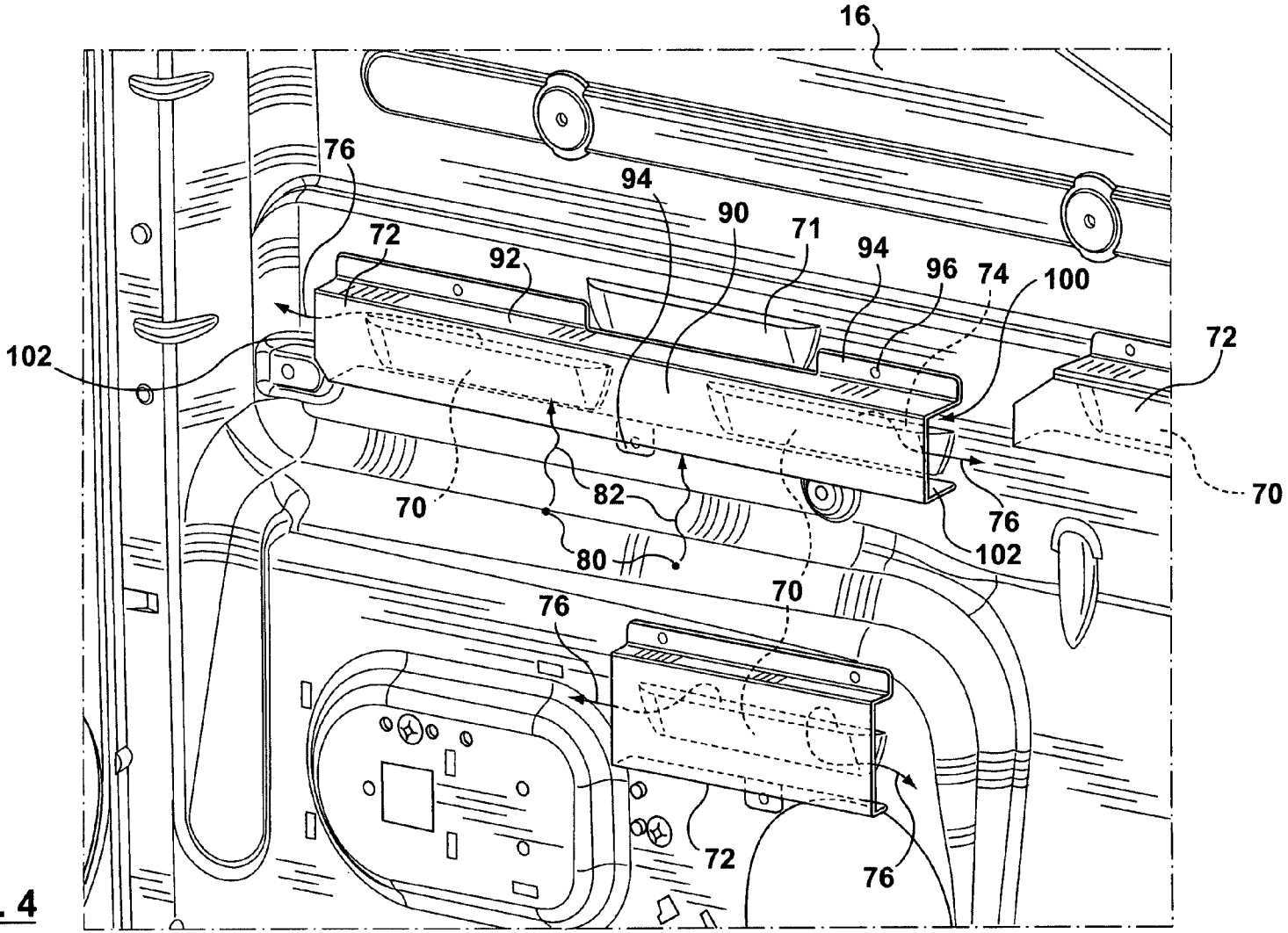
FIG. 4 is a closer perspective view of the rear wall of the dryer cabinet from inside the dryer cabinet.
Figure 5:
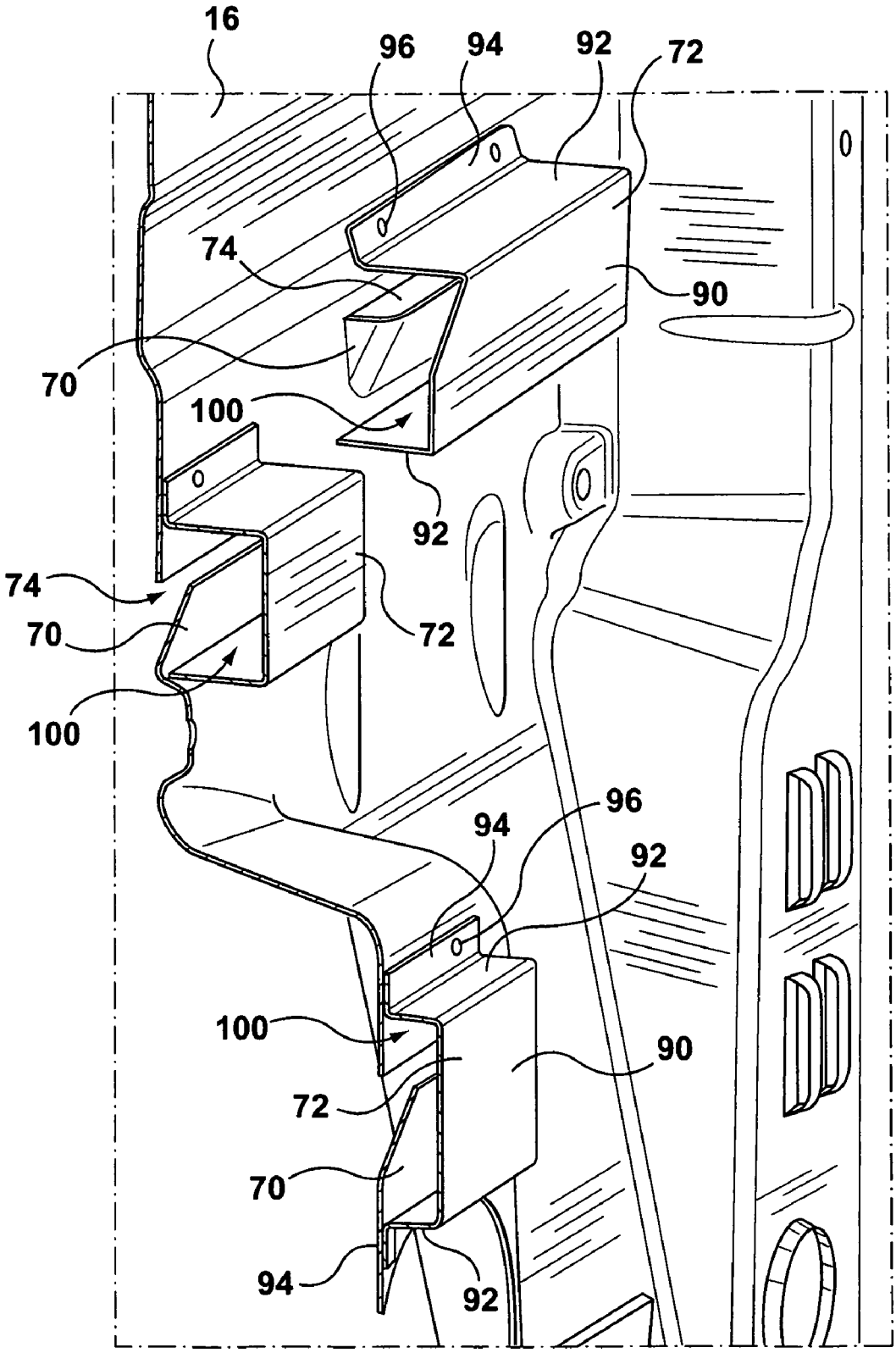
FIG. 5 is an enlarged partial perspective sectional view of the covers of the present invention; and, FIGS. 6A, to 6C show cross-sectional shapes of alternative embodiments for the cover.

As shown in FIGS. 3 to 5, louvres 70 extend horizontally along the rear wall 16 and provide opening 74 in the rear wall through which ambient air may enter as shown by the airflow arrows 76 in FIG. 4. The airflow arrow 76 shows ambient air entering the dryer during normal dryer operation as a result of the operation of the blower fan 48 (FIG. 2).

As shown in FIGS. 3 to 5, covers 72 cover the louvres 70 by overlaying the louvres 70 in spaced relation therefrom. The covers 72 extend along the horizontal length of the louvres 70. In one embodiment, one cover 72 may cover more than one louvre or alternatively, one or more covers 72 may cover one louvre 70. The purpose of the cover 72 is to restrict flow of ignited particles 80 (FIG. 4) and other debris from leaving the dryer cabinet should a fire develop in the dryer. The airflow pattern of the rising ignited particles 80 is generally shown by arrows 82 to be generally upward. Such particles can also fall. However it should be understood that any changes in the current of the airflow may potentially result in the particles 82 moving through the openings 74 of the louvres 70 and exiting the dryer cabinet if the covers 72 are not present. Hence the covers guard against and restrict flow of particles 80, and other debris rising and falling within the cabinet, from exiting the cabinet 12 through the louvre 70.

In the embodiment shown, the covers 72 have a generally u-shaped cross-section provided by an end wall 90 with two side walls 92 that space the cover end wall 90 inwardly into the cabinet 12 away from the rear wall 16 of the dryer cabinet 12. As a result, between the covers 72 and an inner side of the rear wall 16, there is defined an airflow channel 100 which extends along the length of the louvre 70. The side walls 92 further have flanges 94 which lie flush with and are mounted to the cabinet rear wall 16 by suitable means such as screws (not shown) which pass through openings 96 in the flange 94 and into the rear wall 16 of the cabinet 12. The upper flanges 94 are elongate and co-extend, or at least partially co-extend, with the upper side wall 92 whereas the lower flange 94 is a button-like flange that extends out from the lower side wall 92 of the cover 72. The cover 72 preferably is made from steel, similar to the material for the rear wall 16 of the dryer 10. Alternatively, the cover 72 may comprise any suitable material that is resistant to fire.

The cover 72 effectively extends at least along the horizontal length of the louvre to define a horizontally extending airflow channel 100 that allows the ambient air 76 to flow out the horizontally opposed open ends portions 102, defined between an end portion of the cover 72 and the wall 16 of the cabinet, during normal dryer operation. The cover also guards against or restricts the flow of particles 80 from escaping out of the cabinet through the openings 74 in the louvres 70 due to any shifts in air current or rising and falling of the particles or debris. Clearly advantage is found with the covers 72 as they reduce the risk of fires spreading from the dryer cabinet by impeding the flow of ignited particles, and other debris, from passing through opening 74 in louvre 70.

Referring to FIGS. 3, 4 and 5, is can also be seen that the rear wall 16 of the cabinet is shown to include louvre 71 that is uncovered. Louvre 71 remains uncovered because, in the fully assembled dryer, the rear wall of the heater housing 22 (see FIG. 2), or diffuser wall, is very close to the rear wall 16 of the dryer cabinet and covers the louvre 71 whereby debris and ignited particles are restricted from flowing between the heater housing 22 and the rear wall 16.

Figure 6A:
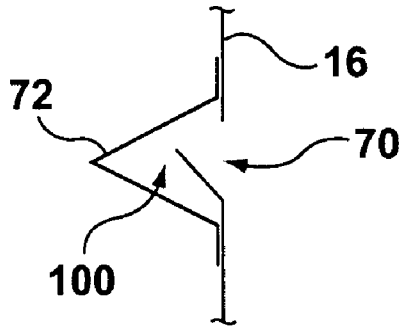
Figure 6B:
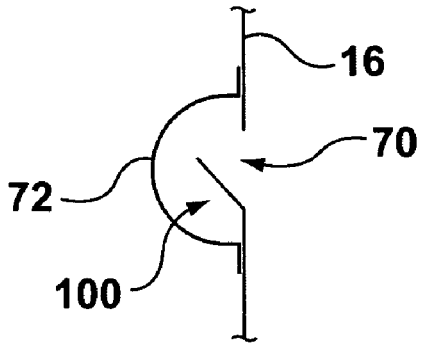
Figure 6C:
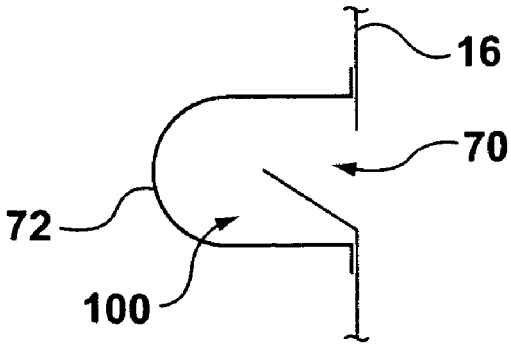

Referring to FIGS. 6A to 6C, the covers 70 are shown respectively to have a triangular V-shaped cross-sectional shape, a semi-circular cross-sectional shape, and a rounded u-shaped cross-sectional shape.

While the invention has been described in terms of various specific embodiments, those skilled in the art will recognize that the invention can be practiced with modifications within the scope of the present invention as disclosed herein.

What is claimed is:

1. A clothes dryer, comprising:

a cabinet having a rear wall;

a louvre located in the rear wall to allow ambient air to enter the cabinet;

a fire-resistant cover mounted inside the cabinet to the rear wall and extending inwardly into the cabinet overlaying the louvre and spaced therefrom, the cover comprising an elongated bracket having at least one side wall extending from the rear wall of the cabinet, the at least one side wall having at least one flange extending therefrom and lying flush with and mounted to an inner side of the rear wall of the cabinet, the bracket defining with the rear wall horizontally opposing open end portions; wherein, the cover extends along the louvre to define with the horizontally opposing open end portions an air flow channel between the cover and the inner side of the rear wall whereby air entering the cabinet through the louvre flows along the air flow channel and through the opposing open end portions into the cabinet while the cover guards against and restricts flow of ignited particles and debris from exiting the cabinet through the louvre and opposite to air flowing in through the louvre, along the air flow channel and out the open end portions into the cabinet.

2. The clothes dryer of claim 1 comprising a plurality of horizontally extending louvres located on the rear wall and a plurality of covers covering the louvres.

3. The clothes dryer of claim 2 wherein the bracket comprises an elongated U-shaped bracket having an end wall spaced from the rear wall of the cabinet by side walls of the bracket extending from the rear wall of the cabinet.

4. The clothes dryer of claim 1 wherein the louvre has a length and the cover extends at least entirely along the length of the louvre.

5. The clothes dryer of claim 1 wherein the cover has one cross-sectional shape selected from the group consisting of a triangular V-shaped cross-sectional shape, a rounded u-shaped cross-sectional shape, a squared u-shaped cross-sectional shape, and a semi-circular cross-sectional shape.

6. A clothes dryer, comprising:

a cabinet having a rear wall;

a louvre located in the rear wall to allow ambient air to enter the cabinet;

a fire-resistant cover mounted inside the cabinet to the rear wall and extending inwardly into the cabinet and overlaying the louvre and spaced therefrom, the cover comprising an elongated bracket having at least one side wall extending form the rear wall of the cabinet, the at least one side wall having at least one flange extending therefrom and lying flush with and mounted to an inner side of the rear wall of the cabinet; wherein, the cover extends over the louvre to define an air flow channel between the cover and the inner side of the rear wall whereby air is permitted to flow into the cabinet through the louvre and along the air flow channel into the cabinet while the cover guards against and restricts flow of ignited particles and debris from exiting the cabinet through the louvre and opposite to air flowing in through the louvre, along the air flow channel and into the cabinet.

7. The clothes dryer of claim 6 comprising a plurality of horizontally extending louvres located on the rear wall and a plurality of covers covering the louvres.

8. The clothes dryer of claim 7 wherein the bracket comprises an elongated U-shaped bracket having an end wall spaced from the rear wall of the cabinet by side walls of the bracket extending from the rear wall of the cabinet, and the bracket having horizontally opposing open end portions whereby air entering the cabinet through the louvre moves along the air flow channel and through the opposing open end portions into the cabinet.

9. The clothes dryer of claim 6 wherein the louvre has a length and the cover extends at least entirely along the length of the louvre.

10. The clothes dryer of claim 6 wherein the cover has one cross-sectional shape selected from the group consisting of a triangular V-shaped cross-sectional shape, a rounded u-shaped cross-sectional shape, a squared u-shaped cross-sectional shape, and a semi-circular cross-sectional shape.

* * * * *